US009427068B2

(12) United States Patent
Seuk

(10) Patent No.: US 9,427,068 B2
(45) Date of Patent: Aug. 30, 2016

(54) BADGE HOLDER

(76) Inventor: Jo Won Seuk, Highland Falls, NY (US)

( * ) Notice: Subject to any disclaimer, the term of this patent is extended or adjusted under 35 U.S.C. 154(b) by 928 days.

(21) Appl. No.: 13/432,894

(22) Filed: Mar. 28, 2012

(65) Prior Publication Data

US 2013/0256348 A1 Oct. 3, 2013

(51) Int. Cl.
*A45F 5/00* (2006.01)
*A45F 5/02* (2006.01)

(52) U.S. Cl.
CPC ..... *A45F 5/00* (2013.01); *A45F 5/021* (2013.01); *A45F 2005/008* (2013.01); *A45F 2200/055* (2013.01)

(58) Field of Classification Search
CPC ..... A45F 2200/055; A45F 2005/008; A45F 2005/006
See application file for complete search history.

(56) References Cited

U.S. PATENT DOCUMENTS

| | | | | |
|---|---|---|---|---|
| 4,821,934 | A | 4/1989 | Alessi et al. | |
| 6,085,449 | A * | 7/2000 | Tsui | A45C 13/42 2/67 |
| 6,270,231 | B1 | 8/2001 | Kerr | |
| 6,840,420 | B1 | 1/2005 | Hudson | |
| 2001/0027834 | A1 * | 10/2001 | Southwick | 150/108 |
| 2001/0054245 | A1 * | 12/2001 | Williams | G09F 3/207 40/661 |
| 2003/0233736 | A1 * | 12/2003 | Faerber | A45F 5/02 24/3.12 |
| 2009/0283559 | A1 * | 11/2009 | Foggiato | A45F 5/00 224/217 |

* cited by examiner

*Primary Examiner* — Brian D Nash
(74) *Attorney, Agent, or Firm* — R. Tracy Crump

(57) ABSTRACT

The badge holder includes a strap member mounted to the back of the badge holder, which allows the badge holder to be securely worn on the hand, wrist or forearm for displaying the badge, while the wearer has full use of both hands.

4 Claims, 12 Drawing Sheets

BADGE HOLDER

This invention relates to badge holders used by police, and in particular a badge holder that can be worn on the hand to display the badge while still allowing the wearer the use of both hands.

BACKGROUND AND SUMMARY OF THE INVENTION

Police and other public safety personnel are often issued a badge as a means of authenticating their authority. Badges are often mounted to holders made of leather or other durable materials, which are in turn worn or carried by the police and public safety personnel. Badge holders are well known and widely used in the art and available in a variety of styles to suite the officer's particular needs. Badge holders are most frequently used by non-uniformed police and off duty police. Plain clothed police will frequently use a badge holder that clips to their belt, but allows the badge to be visible when worn. Because, police are often required to carry their badge and credential with them at all times, wallet style badge holders are used by off duty police officers. Wallet style badge holders allow their badge and credentials to be carried in a pocket. Typically, a wallet style badge holder has folding bodies that allow the officer to selectively display or conceal the badge within the body of the wallet.

While, conventional badge holders allow the police and public safety personnel to conveniently wear and carry their badges, they do not position the badge on the officer's body at the most vital location during the high stress situation of a use of force encounter. When a weapon is presented, the natural human tendency under stress is to visually fixate on the weapon in the hands of the perpetrator. Because of this tendency to visually fixate on the weapon, the badge carried in a badge holder worn on a belt or pinned to the chest may not be perceived or even seen by others responding. With their badge clipped to a belt or pocket, a plain clothed or off duty officer actively engaged in a use of force situation may not be identified as a fellow officer by other officers responding to the situation. The attention of any responding officers will immediately fixate on the weapon in the hands of the as yet unidentified threat. Since visual attention gravitates naturally to the hands under high stress circumstances, it is highly desirable to have a badge holder that can be worn on the hand, wrist or forearm to visually display the badge while still having full use of both hands.

The present invention seeks to provide an improved badge holder that can be securely worn on the hand displaying the badge, while the wearer maintains full use of both hands. Each embodiment of the badge holder of this invention includes a strap or elastic member mounted to the back of the badge holder. The strap or elastic member allows the badge holder to slip over the wearer's hand so that the badge holder is positioned on the back of the hand to display the badge. In certain embodiments of this invention, the elastic member can be added as an attachment to conventional badge holders. In other embodiments, the elastic members are integrated directly to the badge holder configuration.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangements of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
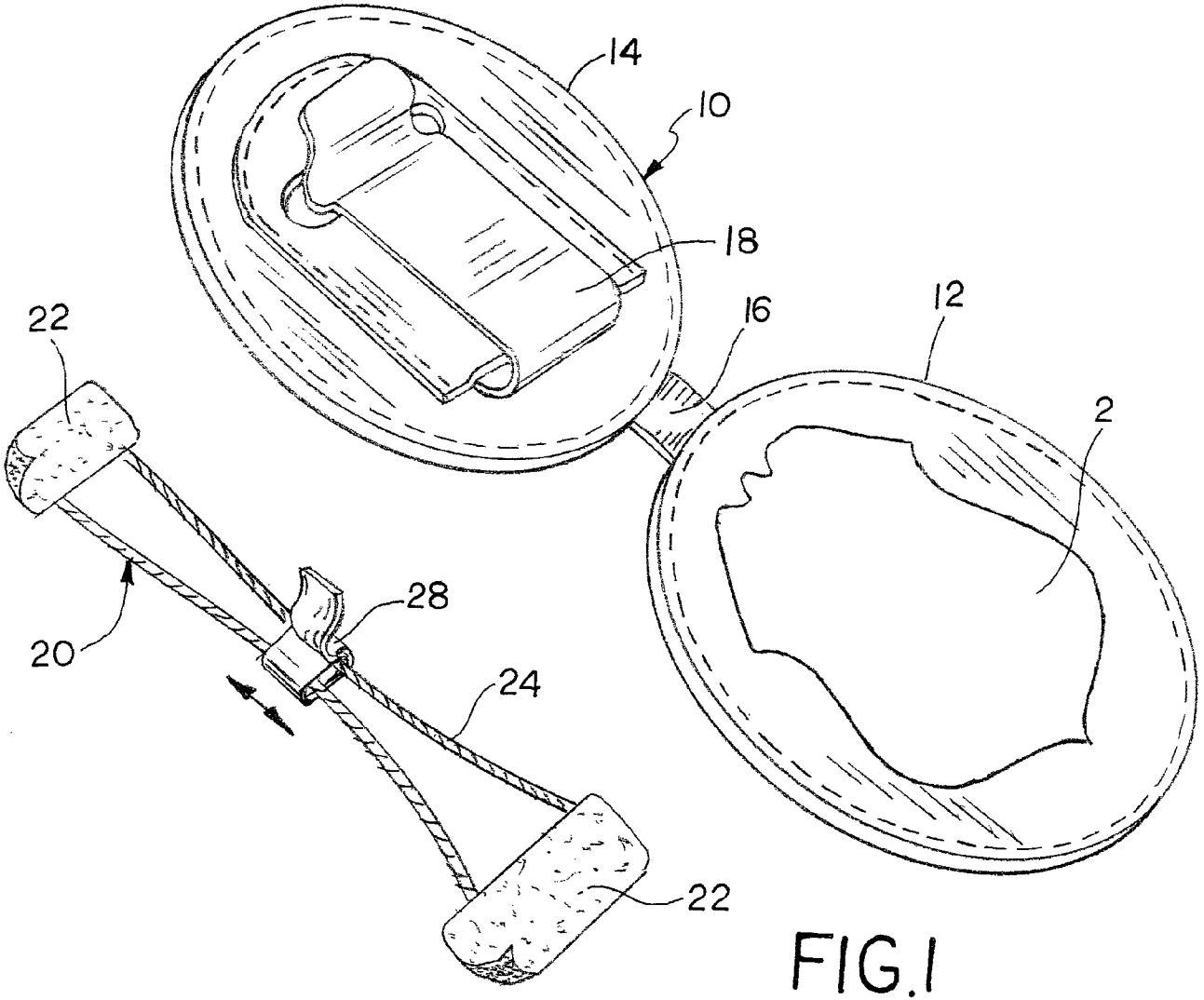
FIG. 1 is a partially exploded perspective view of an embodiment of the badge holder and a hand mounting attachment of this invention.
Figure 3:
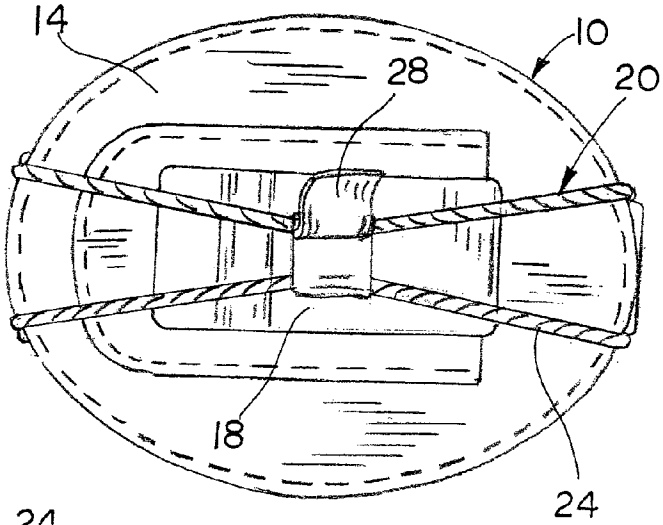
FIG. 3 is a bottom view of the badge holder and hand attachment of FIG. 1.
Figure 2:
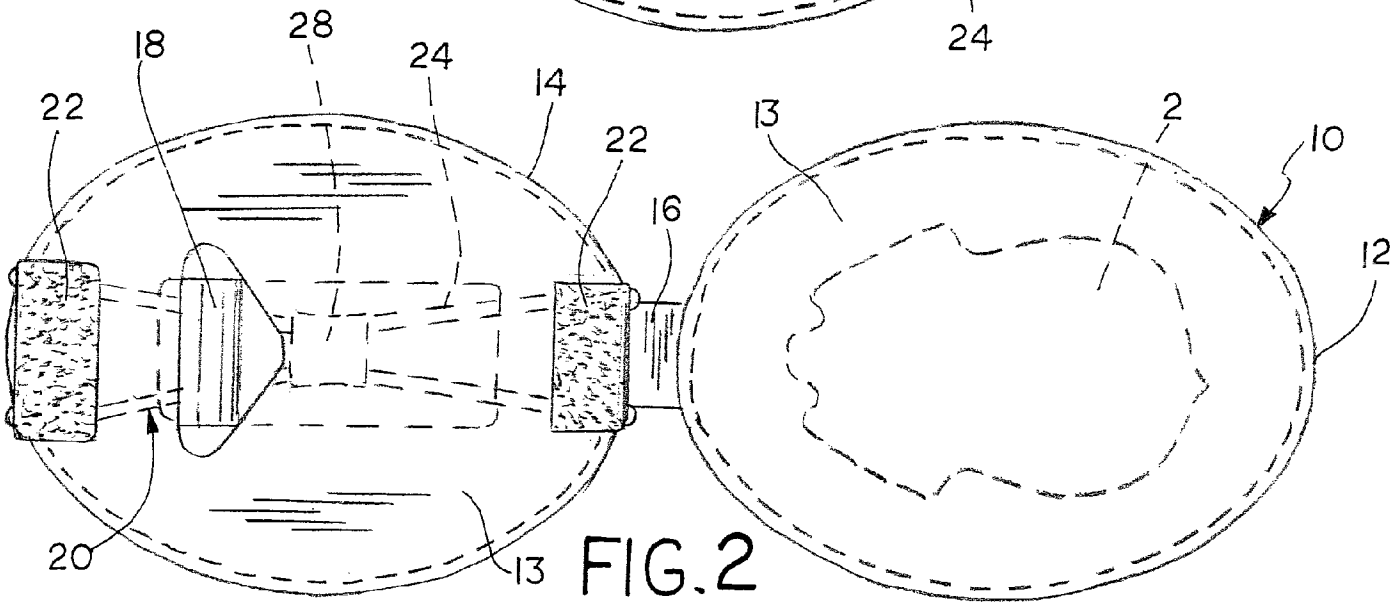
FIG. 2 is a top view of the opened badge holder and the hand mounting attachment of FIG. 1 with the hand mounting attachment connected to the badge holder.
Figure 4:
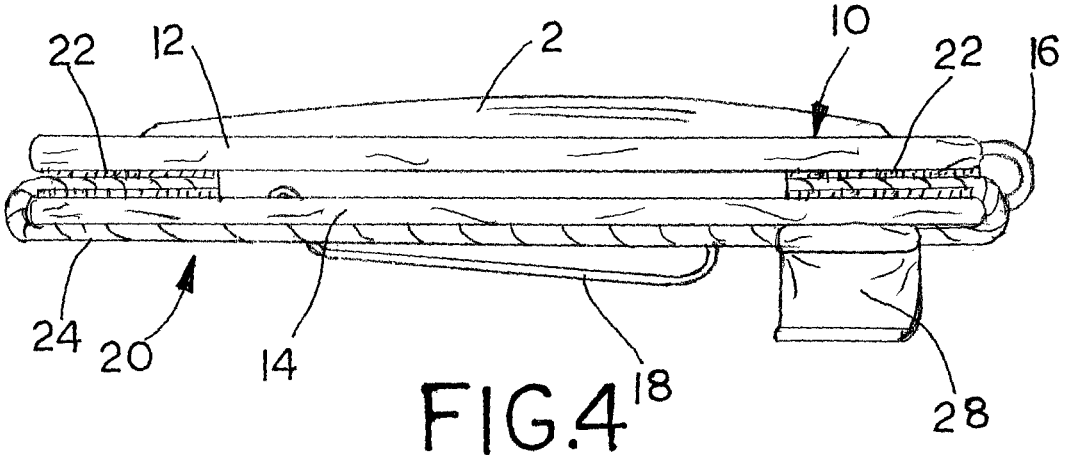
FIG. 4 is a side view of the badge holder and hand mounting attachment of FIG. 1 showing the slide tab moved to the end of the badge holder.
Figure 5:
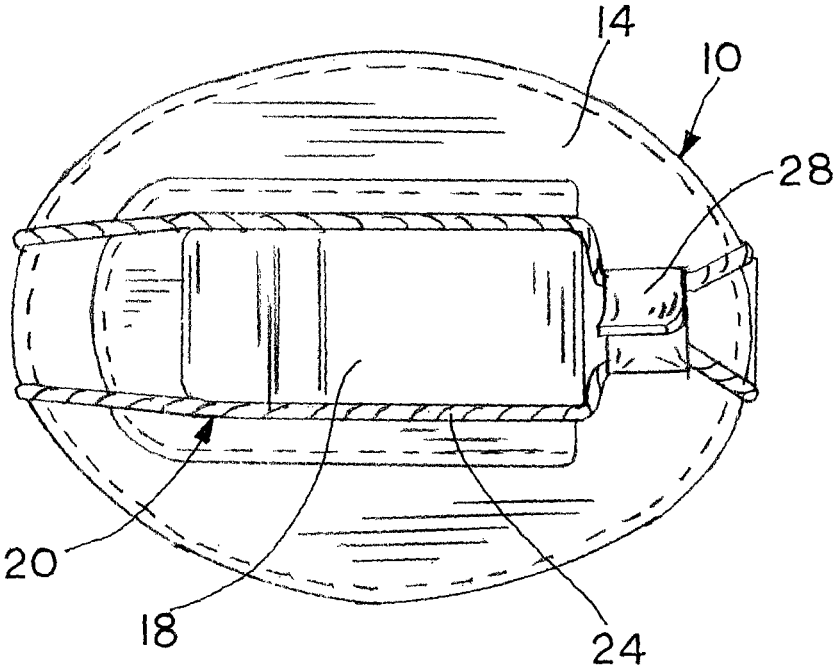
FIG. 5 is a bottom view of the badge holder and hand mounting attachment of FIG. 1 showing the slide tab moved to the end of the badge holder.
Figure 6:
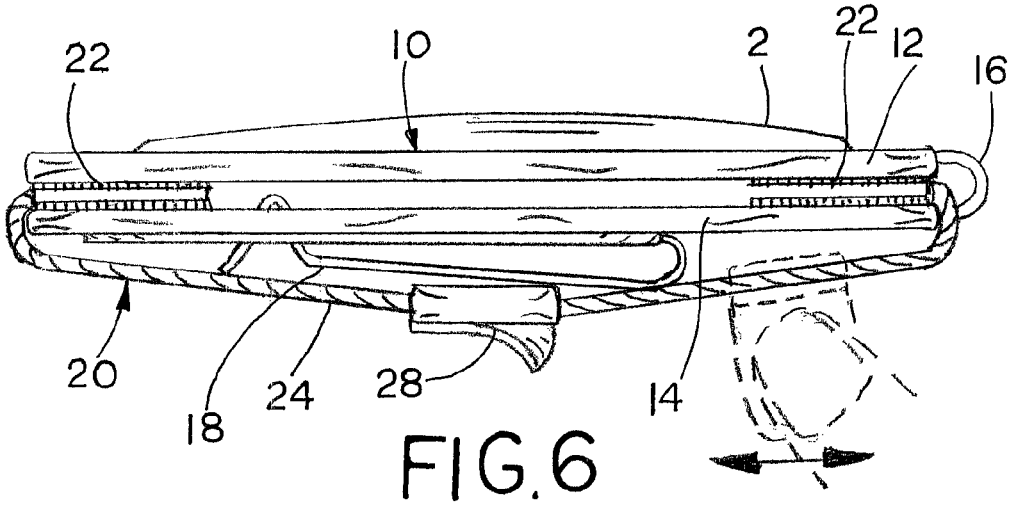
FIG. 6 is a side view of the badge holder and hand mounting attachment of FIG. 1 showing the slide tab moving to the center of the badge holder.
Figure 7:
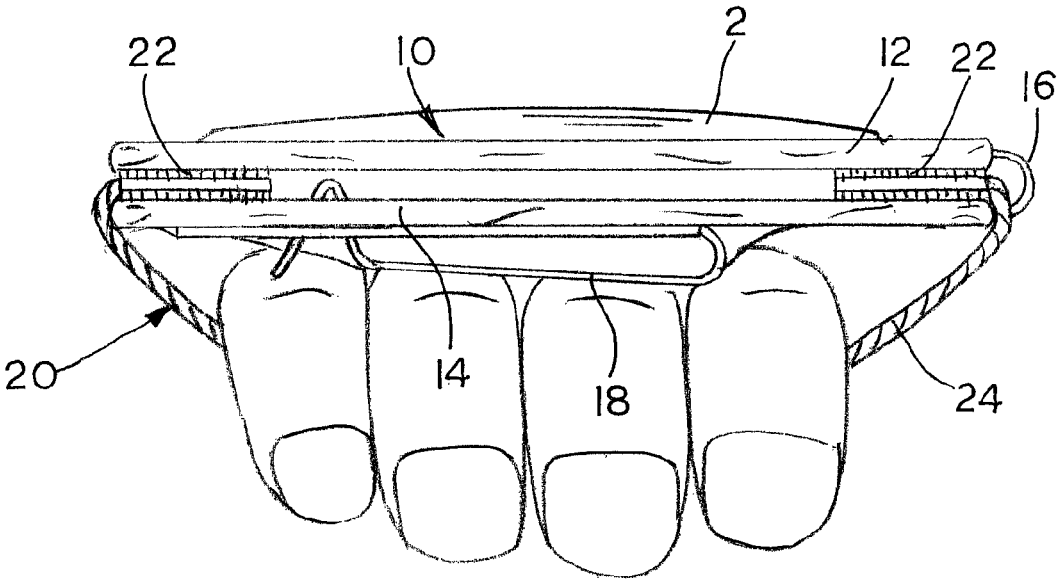
FIG. 7 is a side view of the badge holder and hand mounting attachment of FIG. 1 showing the badge holder worn over the hand.
Figure 8:
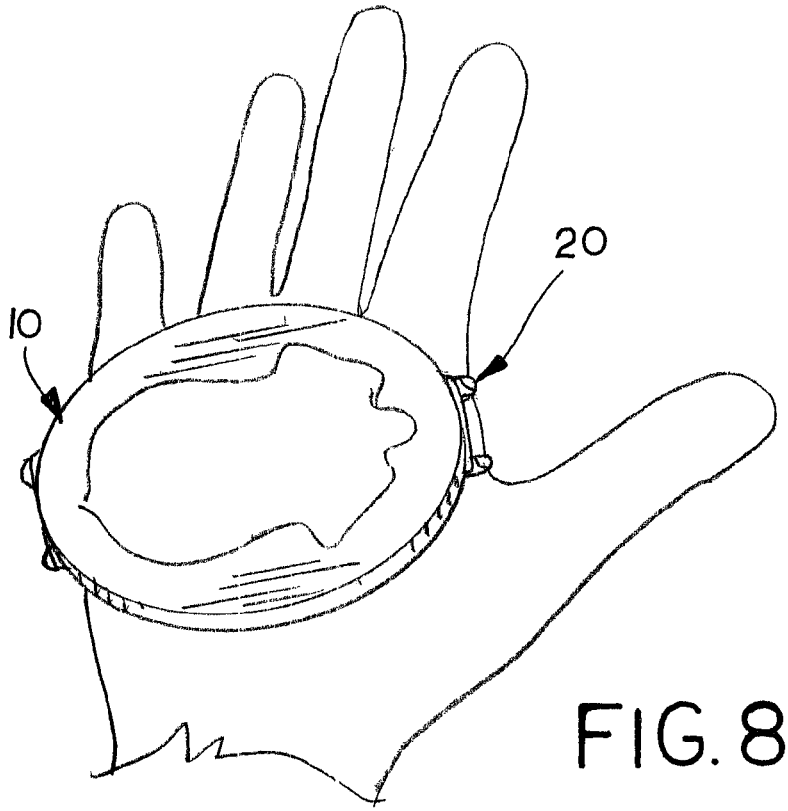
FIG. 8 is a dorsal view of the badge holder and hand mounting attachment of FIG. 1 worn on a hand.
Figure 9:
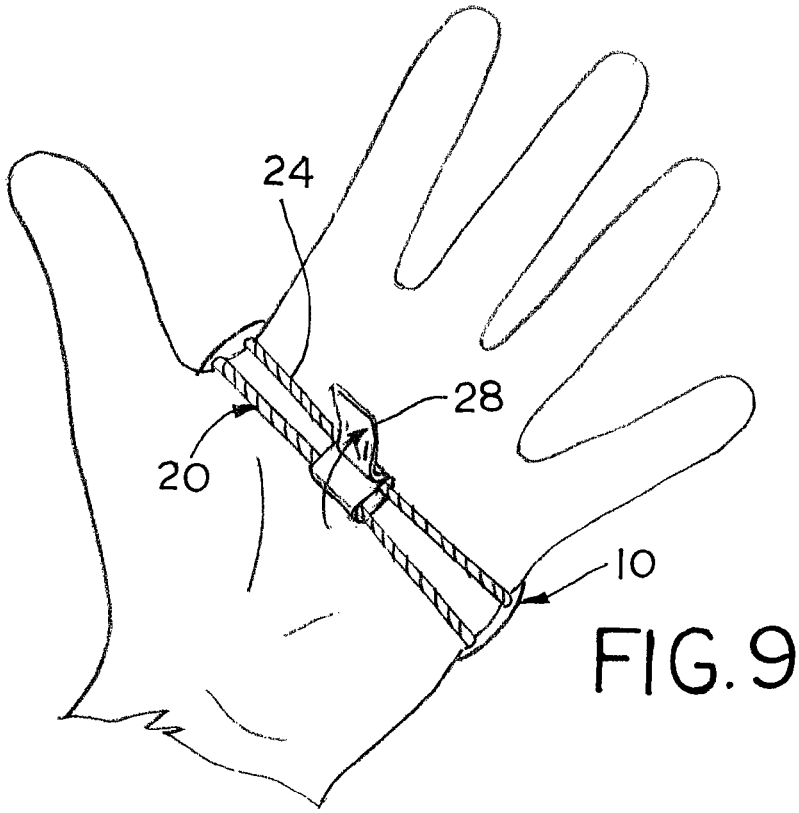
FIG. 9 is a palmar view of the badge holder and hand mounting attachment of FIG. 1 worn on a hand.

Referring now to the drawings, FIGS. 1-9 illustrate a first embodiment of the present invention where a clam-shell type badge holder 10 includes a removable hand attachment 20, which allows the badge holder to be securely worn over a user's hand with the badge fully displayed while the user maintains full use of both hands. As shown, badge holder 10 is a conventional clam shell type badge holder and has a two-piece folding backing 12, which is formed by a front half 12 and a back half 14. The front and back halves 12 and 14 are connected at one end by a small end tab 16 in a clam shell arrangement. Typically, both backing halves 12 and 14 are constructed from two sheets of leather, cloth or other durable fabric. A badge 2 is pinned to the front face of backing half 12. Backing halves 12 and 14 overlie one another to enclose the badge pin and are secured together by hook and loop material 13 mounted on the facing sides of backing halves 12 and 14. A belt clip 18 is mounted to the outer face of the backing 14 so that the badge holder can be secured to a belt or pocket worn by the user.

As shown, hand attachment 20 is connected to badge holder 10 using a hook and loop connection. Hand attachment 20 includes two tabs 22 of nylon webbing sewn to the end of a loop of elastic cord 24. End tabs 22 have patches of hook and loop material 23, which adhere to the hook and loop material on backing half 14. End tabs 22 are sandwiched between backing halves 12 and 14 at opposite ends of the badge holder so that elastic loop 24 extends over the back of badge holder 10 and around belt clip 18. A slidable pull tab 28 rides along the length of elastic loop 24 and allows the elastic loop to be pulled away from the back of badge holder 10.

Figure 10:
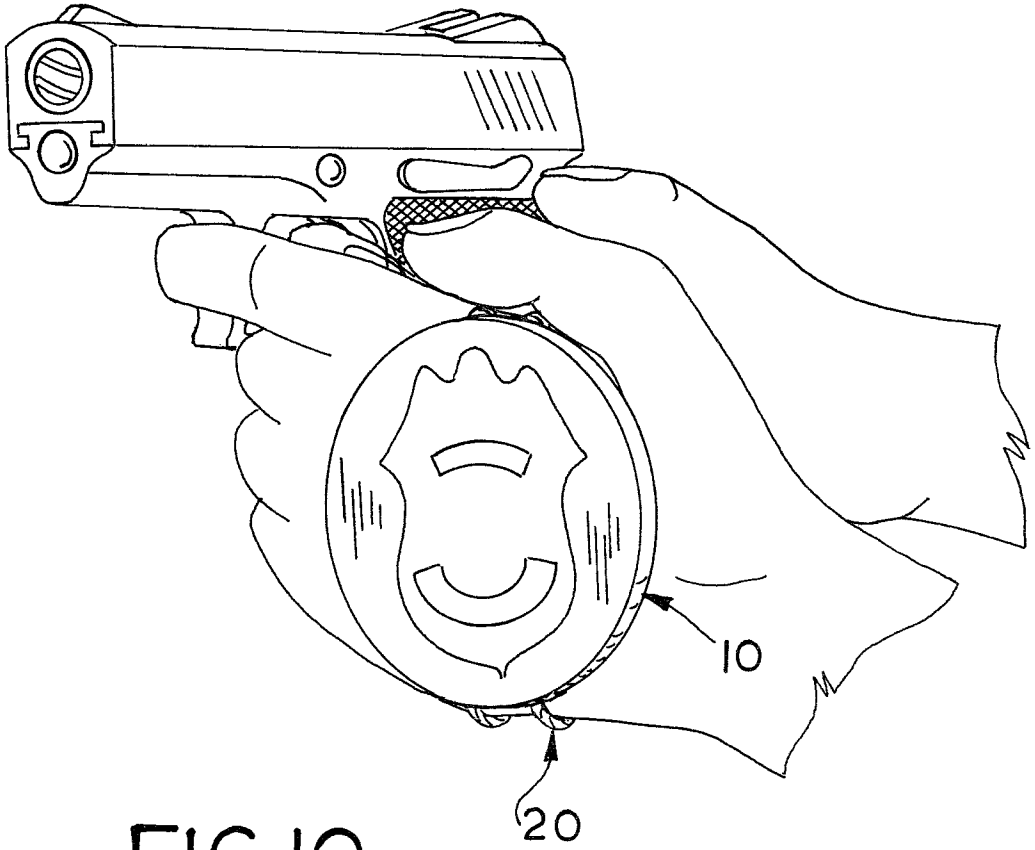
FIG. 10 is a partial perspective view of a user wearing the badge holder and hand mounting attachment of FIG. 1.

FIGS. 6-10 illustrate how hand mounting attachment 20 enables badge holder 10 to be worn on a user's hand. As shown, badge holder 10 slides onto the user's hand so that the badge holder 10 lays across the back of the user's hand with the badge 10 facing outward and elastic cord loop 24 stretches across the user's palm. Elastic cord loop 24 stretches to receive the user's fingers and provides enough tension to securely hold badge holder 10 to the back of the user's hand. Pull tab 28 allows the user to pull elastic loops 22 outward away from the back of badge holder 10 to help facilitate sliding the fingers under the elastic loop and quickly donning the badge holder to the user's hand. With badge holder 10 secured to the back of the user's hand, the user has full use of his hands. When the user presents a weapon using a conventional two hand grip, the badge is clearly visible (FIG. 10).

Figure 11:
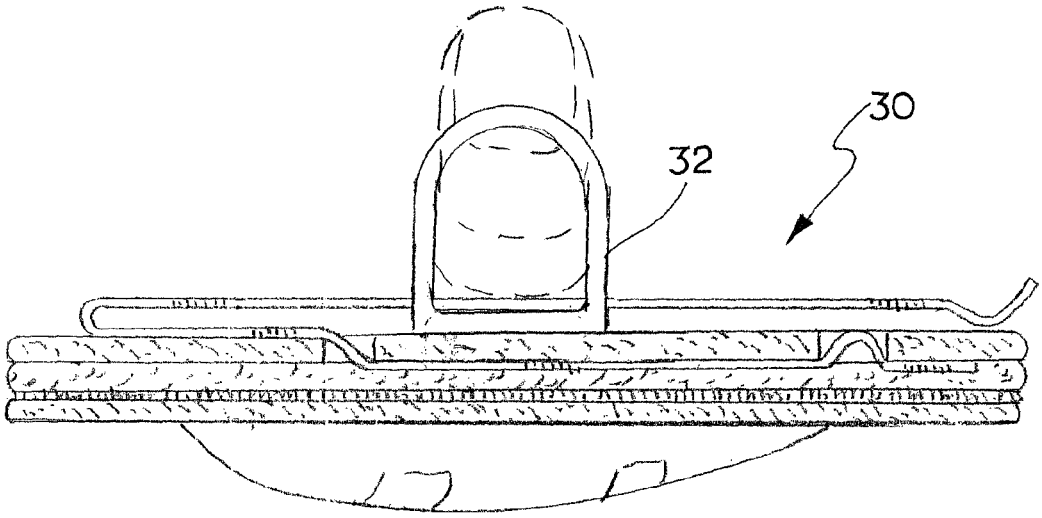
FIG. 11 is a side view of a second badge holder embodiment of this invention.
Figure 12:
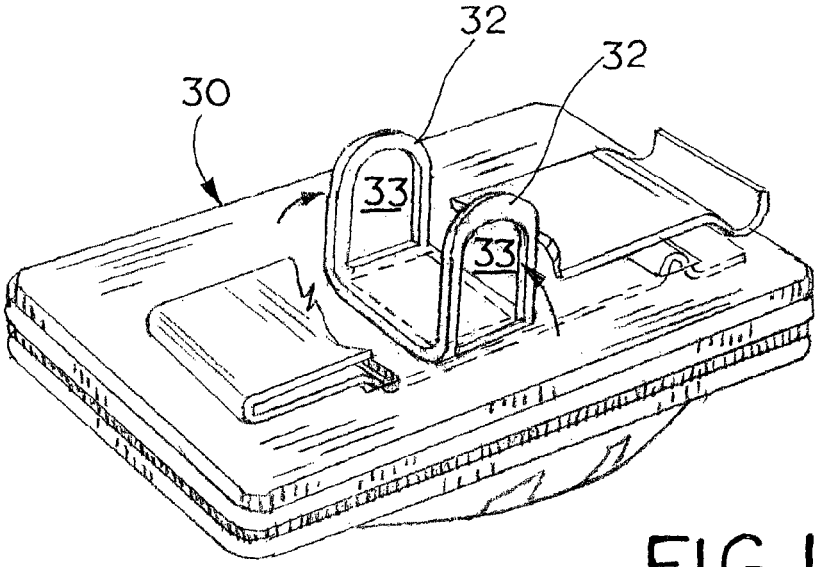
FIG. 12 is a bottom perspective view of the badge holder of FIG. 11.

FIGS. 11 and 12 illustrate a second embodiment of this invention where a clam shell type badge holder 30 includes integral finger tabs 32, that act as finger straps. Finger tabs 32 are formed by a piece of leather or nylon sewn to the back of the badge holder. The ends of the leather piece fold outward and have cutout openings to received the user's finger therethrough. With the user's finger inserted through openings 33 in finger tabs 32, badge holder 30 can be supported on the hand.

Figure 13:
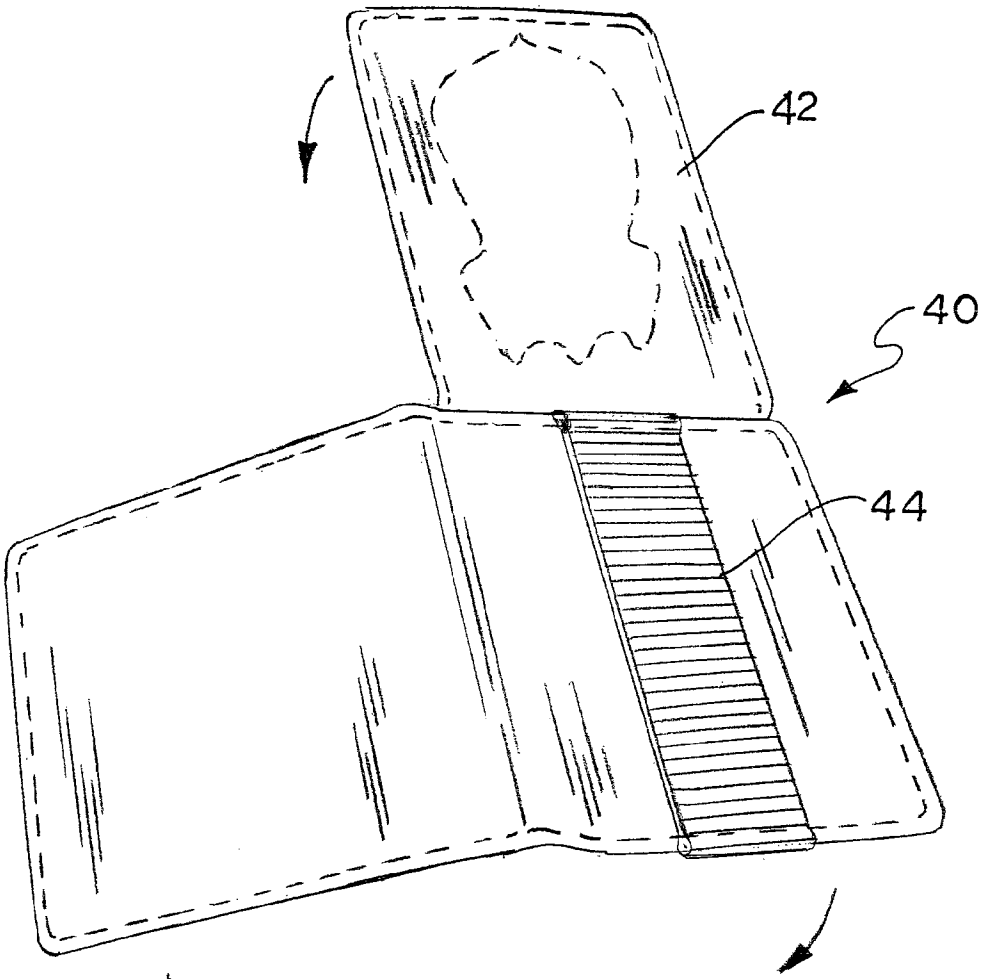
FIG. 13 is a perspective view of a third badge holder embodiment of this invention.
Figure 14:
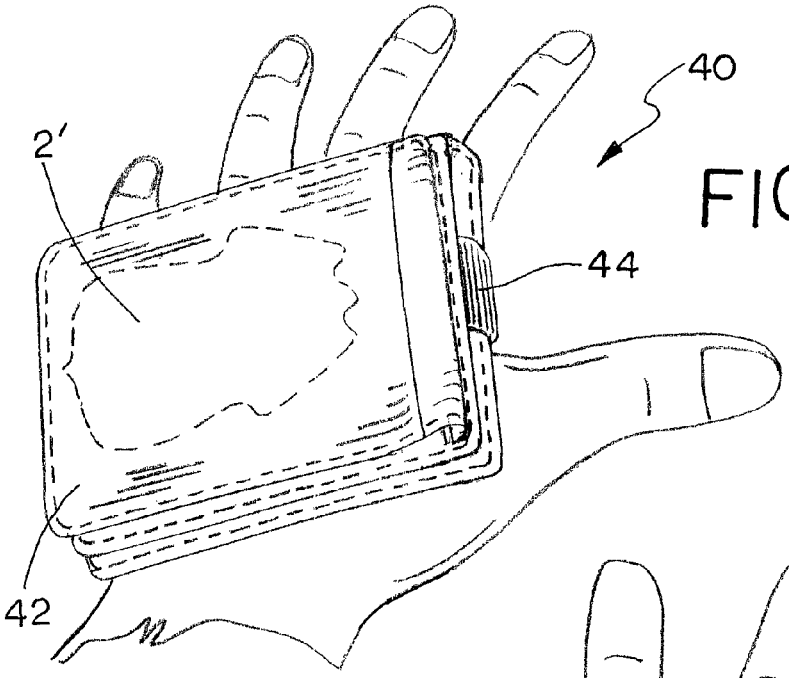
FIG. 14 is a dorsal view of the badge holder of FIG. 13 worn on a hand.
Figure 15:
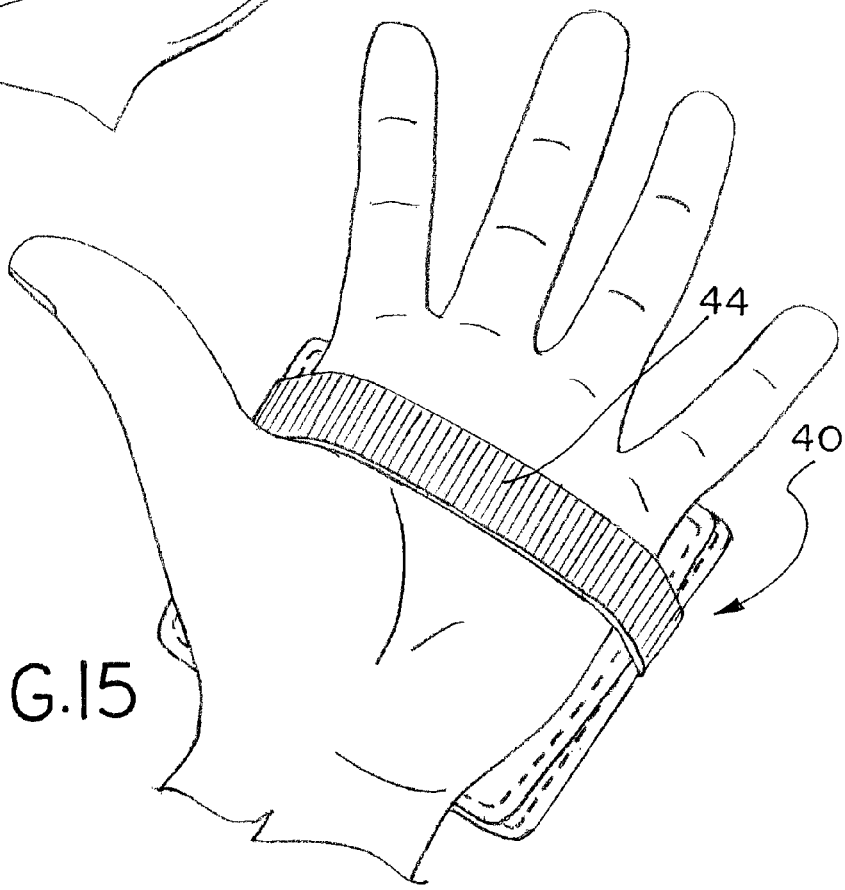
FIG. 15 is a palmar view of the badge holder of FIG. 13 worn on a hand.
Figure 17:
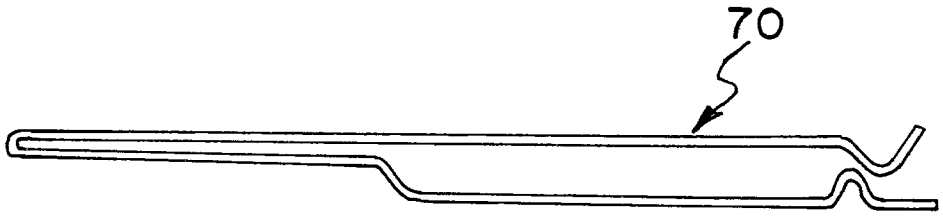
FIG. 17 is a side view of a badge holder belt clip for use with the belt clip attachment of FIG. 16.
Figure 16:
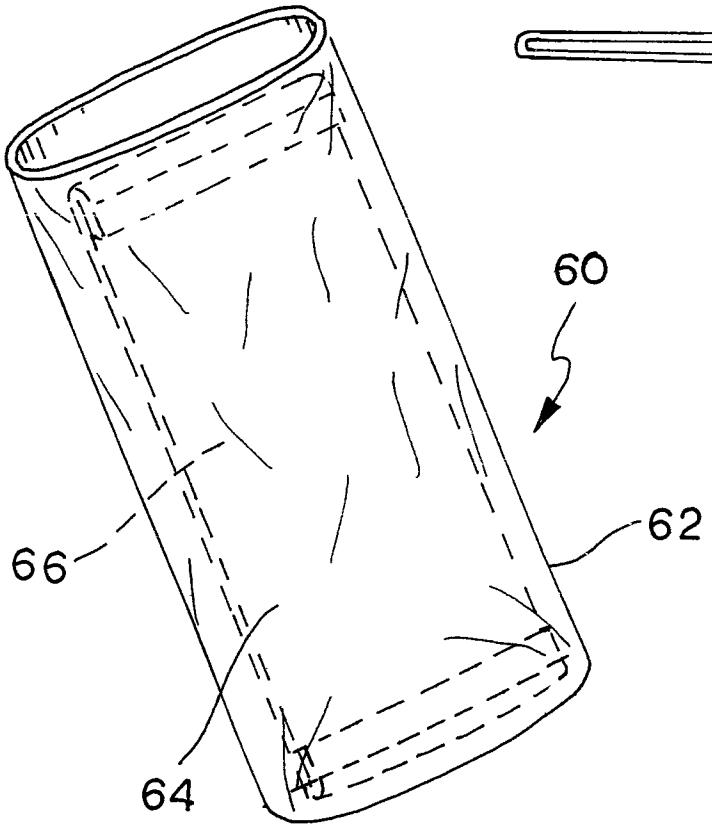
FIG. 16 is a perspective view of a belt clip attachment for a badge holder of this invention.
Figure 18:
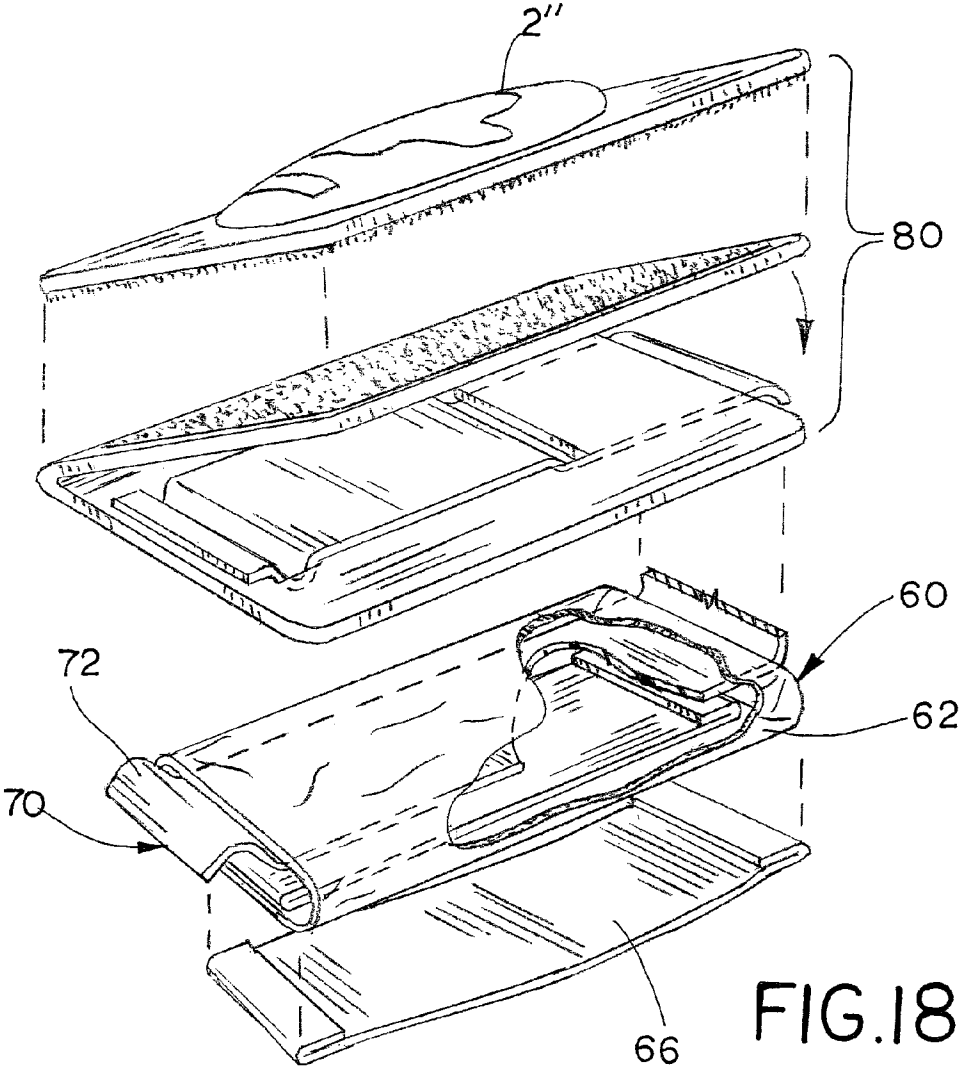
FIG. 18 is a partial exploded view of a badge holder with the belt clip of FIG. 17 and the belt clip attachment of FIG. 16.

FIGS. 13-15 illustrate a second embodiment of the present invention where an elastic band or strap 60 is integrally mounted to the back of a wallet style badge holder 50 so that the badge holder can again be securely worn over a user's hand with the badge fully displayed while the user maintains full use of both hands. As shown, badge holder 40 is a variation of a conventional tri-fold wallet and includes a backing part 42 to which badge 2' is pinned. Elastic band 44 is sewn into the back of badge holder 40 and overlies the back of the holder. Similar to the embodiment of FIGS. 1-10, the user's hand slide underneath elastic band 44 so that badge holder 40 is supported on the back of the hand with badge 2' fully visible.

Figure 19:
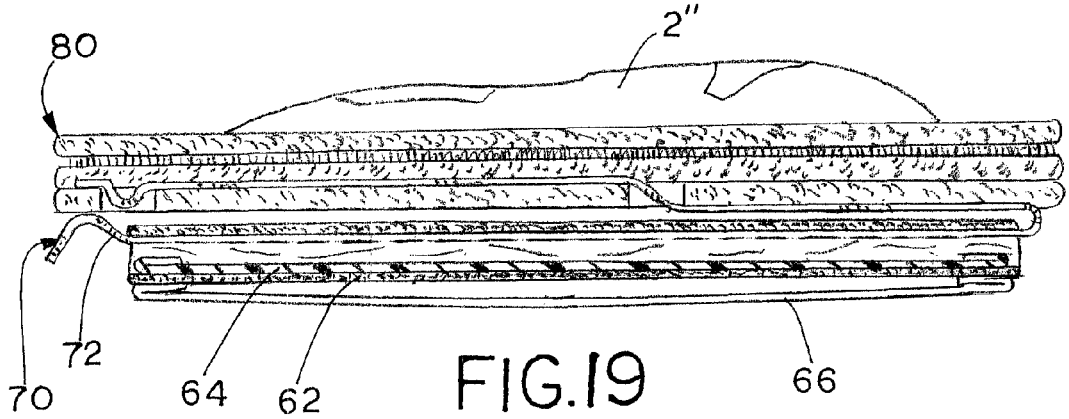
FIG. 19 is a side view of the badge holder, belt clip and belt clip attachment of FIG. 18.
Figure 20:
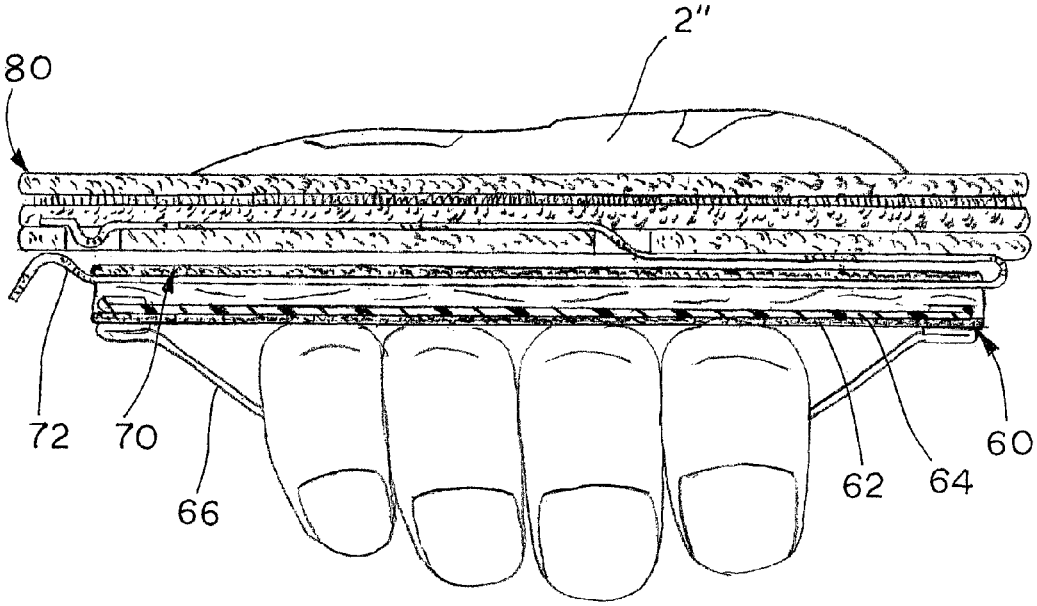
FIG. 20 is a side view of the badge holder, belt clip and belt clip attachment of FIG. 18 shown worn on a hand.

FIGS. 16-20 illustrate another embodiment of this invention, which includes a belt clip attachment 60, which slides onto a modified belt clip 70. Both belt clip 70 and clip attachment 60 can be modified and adapted for used with any conventional badge holder. FIGS. 19 and 20 illustrate belt clip 70 and clip attachment 60 used on another clam shell badge holder 80. Clip attachment 50 is generally constructed of a cloth material and includes a tubular sleeve 62 that slides over the exposed leg 72 of belt clip 70. An internal stiffer 64, which ideally is a long flat piece of plastic is sewn within sleeve 62, to prevent the sleeve from bunching up when badge holder 80 is clipped to a belt. An elastic band 66 is sewn to the back of sleeve 62 and overlies the back of the sleeve. Similar to the embodiments of FIGS. 1-10 and FIGS. 13-15, the user's hand slides underneath elastic band 44 so that badge holder 40 is supported on the back of the hand with badge 2' fully visible. Belt clip 70 is modified from conventional belt clips to have a longer exposed leg 72. The additional length of the exposed clip leg 72 allows for a longer clip attachment so that the user can slide his/her entire hand under elastic band 66.

While multiple embodiments of the present invention are illustrated in the drawings and described herein, each embodiment allows the badge holder to be securely worn on the hand, while the wearer has full use of both hands. Straps and elastic members, whether elastic cords, elastic bands, finger straps or any cinch type strap mounted to the backs of the badge holders allow the badge holder to be worn on the user's hand, while not affecting the use of a belt clip or making the badge holder unwieldy. In certain embodiments of this invention, the elastic member can be added as an attachment to conventional badge holders. In other embodiments, the straps and elastic members are sewn directly to the badge holder to integrate the hand support feature into the functionality of the badge holder. It should be noted that the hand support feature of this invention provided by the elastic members can be incorporated into any style or configuration of badge holder regardless of make or material, without deviating from the teachings of this invention.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A badge holder adapted to support a badge, the holder comprising:

a first flat backing member having a front surface and opposed back surface;

a second flat backing member having a front surface and an opposed back surface, the front surface of the second backing member adapted to support the badge thereon;

a backing tab pivotally connecting the first backing member to the second backing member so that the second backing member folds over the first backing member between a first position where the back surface of the second backing member overlies the front surface of the first backing member and a second position where the front surface of the second backing member overlies the back surface of the first backing member;

a belt clip affixed to the back surface of the first backing member;

a length of elastic cord having opposed ends connected together to from a cord loop, the cord loop detachably connected at opposite ends thereof to the front surface of the first backing member to overlie the back surface of the first backing member adjacent the belt clip so that the cord loop constitutes means for supporting the badge holder on a user's hand when the user's hand is received between the cord loop and the first backing member; and a sliding tab mounted to the cord loop for shiftable movement thereon along the cord loop between the opposite ends of the cord loop over the belt clip and adapted to be manually grasped to pull the cord loop away from the belt clip and first backing member.

2. The badge holder of claim 1 and first and second tabs connected to the opposite ends of the cord loop, the first and second tabs detachably secured to the first backing member by mating hook and loop fasteners.

3. The badge holder of claim 1 wherein the belt clip extending from the back surface of the first backing member through the cord loop when the sliding tab is located adjacent either of the opposite ends of the cord loop.

4. The badge holder of claim 3 wherein the backing tab disposed through one of the opposed ends of the cord loop.

* * * * *